US005898976A

United States Patent [19]

Leonardi, Sr. et al.

[11] Patent Number: 5,898,976

[45] Date of Patent: May 4, 1999

[54] ROLLER CAM AND SPRING ACTUATED HINGE

[75] Inventors: Ezio Leonardi, Sr., Weedsport; Joseph Leonardi, Auburn, both of N.Y.

[73] Assignee: Leonardi Manufacturing Co., Inc., Weedsport, N.Y.

[21] Appl. No.: 08/912,219

[22] Filed: Aug. 15, 1997

[51] Int. Cl.[6] ..... E05F 1/12

[52] U.S. Cl. ..... 16/278; 16/296; 16/387; 383/34; 150/120; 150/123; 190/106

[58] Field of Search ..... 150/120, 123; 190/106; 383/34, 43; 16/291, 293, 296, 278, 387

[56] References Cited

U.S. PATENT DOCUMENTS

| | | | |
|---|---|---|---|
| 1,262,288 | 4/1918 | Vom Eigen | 190/106 |
| 2,142,764 | 1/1939 | Kluger | 383/34 |
| 2,158,955 | 5/1939 | Blacher | 190/106 |
| 2,578,612 | 12/1951 | Stregack | 150/120 |
| 2,611,922 | 9/1952 | Borman et al. | 16/296 |
| 2,903,033 | 9/1959 | Robinson | 190/122 |
| 3,145,749 | 8/1964 | Leonardi | 383/34 |
| 4,524,486 | 6/1985 | Rios et al. | 383/34 |
| 5,546,633 | 8/1996 | Liu | 16/293 |

*Primary Examiner*—Chuck Y. Mah
*Assistant Examiner*—Donald M. Gurley
*Attorney, Agent, or Firm*—George R. McGuire

[57] ABSTRACT

A female hinge member, and a hinge assembly including the member, includes a pair of spaced ears between which a cylindrical roller is supported for rotation about an axis parallel to the axis about which the female hinge member and a pivotally attached male hinge member are relatively rotatable. The hinge assembly is connected to opposite end portions of a framework forming part of a handbag. As the hinge members are relatively rotated in moving between open and closed positions, the roller moves along the surface of a cantilever spring on the male hinge member, in rolling contact therewith.

13 Claims, 3 Drawing Sheets

FIG. 1
PRIOR ART
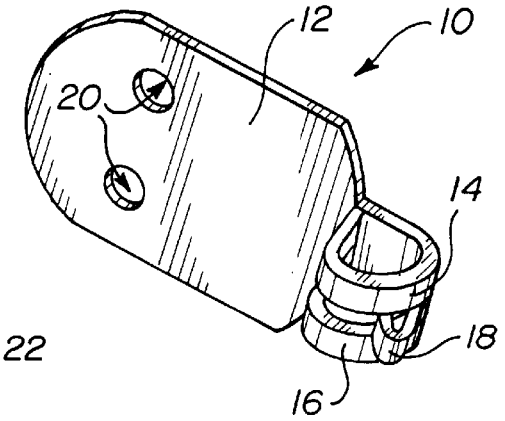
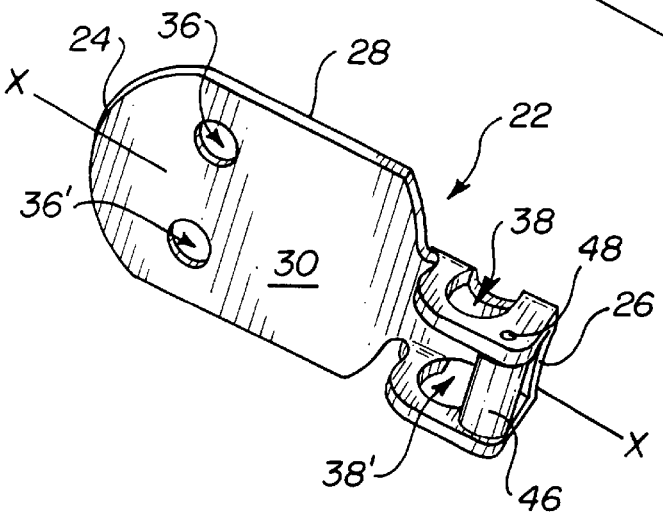
FIG. 2
FIG. 3
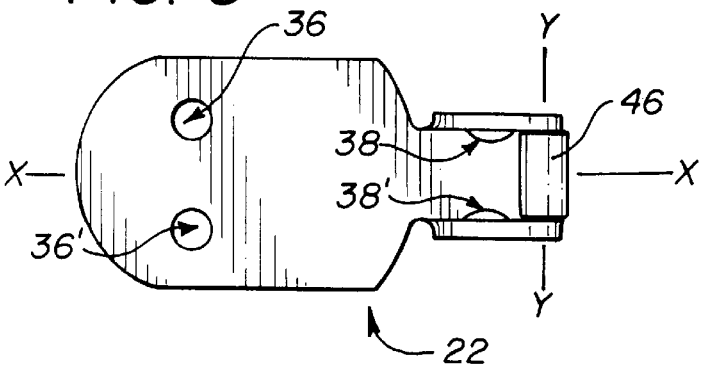
FIG. 4
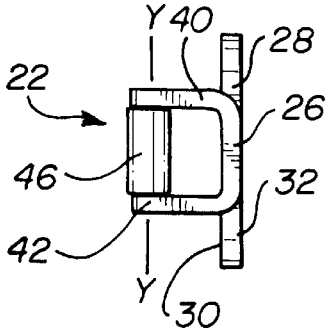
FIG. 5
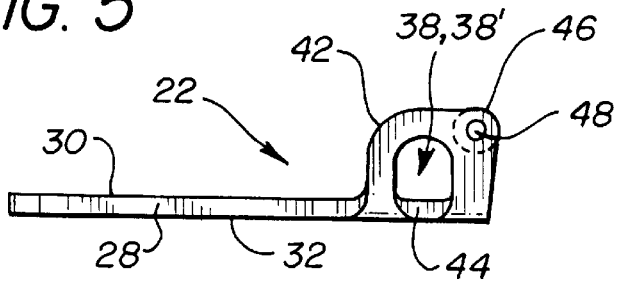

ROLLER CAM AND SPRING ACTUATED HINGE

BACKGROUND OF THE INVENTION

The present invention relates generally to hinges, and more particularly to cam and spring actuated hinges for use in combination with a handbag frame that is positioned at the mouth of a bag and permits the bag to securely remain in either a terminal open or closed position.

It is old and well known to those skilled in the art to which the present invention pertains to provide a snap-action type, hinged frame for use on handbags (handbags is used herein as a generic term which includes purses, pocket books, brief cases, and the like). The prior art handbag frames are generally comprised of two elongated strips of metal hingedly connected, in parallel extending relation, to one another. One of these frames is positioned at the mouth of the handbag, and due to the hinged connection of the frame members, the frame permits selective opening and closing of the handbag.

The hinges employed in the frame construction are typically known as over-center spring hinges. This type of hinge permits the handbag to be manually snapped open or closed, and remain in a fixed, open or closed, terminal position until manually moved to the opposite terminal position. To achieve this goal, the hinges generally include male and female portions, each having a leaf for attaching it to a respective frame member, and a pair of cooperatively positioned eyelets for receiving a pivot pin therethrough. Passage of the pivot pin through the male and female portions' eyelets forms the pivotal, hinged connection between the two portions. In addition to the eyelets, the male portion also includes an elongated spring finger integrally extending from the leaf, while the female portion includes a fixed cam or lug integrally formed at the distal end of the leaf with the lobe of the cam positioned in spring biased relation to the spring finger.

In operation, as the handbag is manually moved from a closed to an open position, the pivotal connection between the male and female hinge portions effect a sliding movement of the cam along the length of the spring finger which, in turn, results in the spring finger yielding to the pressure applied thereto by the lobe of the cam. Once the lobe of the cam extends more than midway along the length of the spring finger, the resilient nature of the spring causes the hinge to snap open to its terminal, open position. If the bag's user stopped the opening motion prior to the cam reaching the midpoint of the spring finger's length, the hinge would simply snap shut. In any event, it is the positional (angular) relationship between the cam and spring finger (in other words, the angular relationship between the two hinge portions) which cause the frame, and hence the handbag, to snap to either a terminal open or closed position. Examples of such hinges are exemplified in U.S. Pat. Nos. 3,145,748 to Leonardi; 2,903,033 to Robinson; 2,158,955 to Blacher; and 2,578,612 to Stregack, among others.

Although the hinges employed in the prior art handbag frames work well, they do suffer the drawback of having a limited life cycle. Due to the constant opening and closing of a handbag, the hinges are constantly being moved between their terminal positions. Each time the bag is opened or closed, the lobe of the cam slides along the length of the spring finger, eventually resulting in the spring and lobe becoming worn, and possibly fractured, due to the constant friction between the two. The wear eventually results in the lobe yielding insufficient pressure on the spring to permit effective operation of the hinge, and hence, the bag.

It is therefore a principal object of the present invention to provide an over-center spring hinge, for use in combination with a handbag frame, that has improved durability and thus, a longer life cycle.

It is an additional object of the present invention to provide an improved hinged frame for a handbag that makes the bag easier to snap open or close than bags utilizing prior art hinges.

It is a further object of the present invention to provide a hinged frame for a handbag that is inexpensive to manufacture.

It is yet another object of the present invention to provide a hinged frame for a handbag that is easy to implement with a handbag.

Other objects and advantages of the present invention will in part be obvious and in part appear hereinafter.

SUMMARY OF THE INVENTION

In accordance with the foregoing objects and advantages, the present invention provides a novel and improved snap-action, spring and cam actuated hinge (i.e., an over-center spring hinge) for use in combination with a handbag frame intended to be positioned in defining relation about the mouth of the handbag. The hinge permits the frame, and hence the handbag, to be securely and statically held in either a terminal open or closed position.

The frame which is used with the hinge of the present invention is conventional in that it is generally comprised of a pair of elongated, flat metal strips hingedly connected to one another at their ends, and positioned in parallel extending relation to one another. Each of the elongated strips is comprised of several, metal segments connected in end to end relation by rivets or other suitable fasteners. The material chosen for the frames must have flexible and resilient characteristics, such as is found with aluminum. It will be understood, however, that the hinge assembly of the present invention may be empolyed in connection with a variety of conventional framework constructions without departing from the scope of the invention.

One strip includes one male hinge portion attached to each of its opposing ends, while the other strip includes one female hinge portion attached to each of its ends. Each hinge portion includes a flat leaf (or body) which attaches to the strips, and a pair of rolled eyelets integrally extending from the leaf portions and through which a pivot pin may pass. The eyelets on the male and female portions are all axially aligned with respect to one another so as to receive a pin through each of the eyelets, thereby pivotally interconnecting the two portions, and thus, the two strips as well.

In addition to the eyelets, the male hinge portion also includes an elongated spring finger integrally extending from the leaf in a cantilevered manner, while the female hinge portions also includes a roller cam rotatably attached across the distal end of the leaf. When the male and female hinge portions are joined together by the pivot pin, the roller cam is positioned in biased relation to the finger spring, resulting in the hinge being in either a terminal open or closed position depending upon the angular relation between the two hinge portions. If the two portions are separated by less than 45 degrees, the hinge will spring into a closed position, whereas if the two portions are separated by more than 45 degrees, the hinge will spring into a terminally open position.

Physically, as the two frame members are either manually separated or brought together, the roller cam will roll along the length of the spring finger which yields as a result of the biasing force exerted by the cam. By having the cam roll as opposed to slide, there is minimal friction at the cam and spring finger interface, thereby resulting in minimal wear on the hinge.

In the absence of external forces, the resilient nature of the spring finger will result in a force on the roller cam that will push the cam to either the terminal proximal or distal end of the spring finger, (the distal end if the manual, external force stops when the roller cam is positioned on the distal half of the spring finger, or the proximal end if the external force is stopped when the roller cam is positioned on the proximal half of the spring finger). Thus, a handbag having a frame employing the present hinges will spring open or closed, and securely remain in either the open or closed position until the user manually forces the bag to its opposing terminal position.

BRIEF DESCRIPTION OF THE DRAWINGS

FIG. 1 is a perspective view of a female hinge member of the prior art;

FIG. 2 is a perspective view of the preferred embodiment of the female hinge member of the present invention;

FIGS. 3, 4, and 5 are top plan, end elevational and side elevational views, respectively, of the hinge member of FIG. 2;

DETAILED DESCRIPTION

Figure 6:
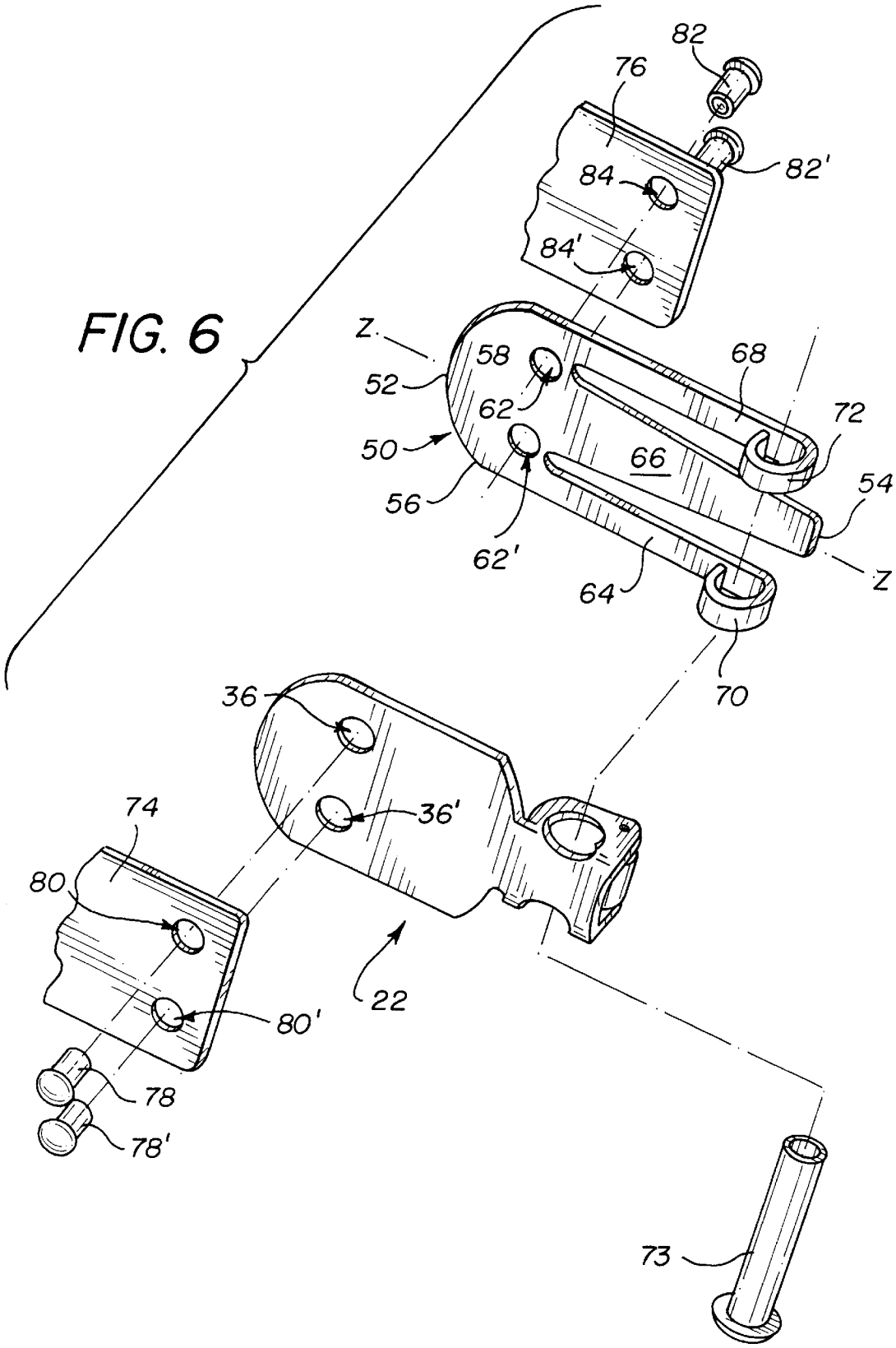
FIG. 6 is a fragmentary, exploded, perspective view of the hinge assembly of the invention, with portions of the framework pivotally connected thereby.

Referring now to the drawings, in FIG. 1 is shown female hinge member 10 of a popular type of prior art hinge assembly used primarily in connection with metal frameworks of certain types of handbags. Hinge member 10 is formed from an initially flat, unitary blank of suitably rigid, non-corrosive metal having body portion 12 with a pair of spaced, parallel fingers extending from one end thereof. After the blank is formed, the fingers bend back upon themselves to form coaxial, open loops 14 and 16. Between the loops is protrusion or cam 18, formed by bending another finger of the blank back upon itself. A pair of spaced, through openings 20 are formed in body portion 12 for passage of rivets, or the like, for fastening hinge member 10 to a first frame element which is to be hingedly attached to a second frame element.

The prior art male hinge member which is attached to the second frame element to cooperatively engage female hinge member 10 is the same as that with which the female hinge member of the present invention is used. As later explained in greater detail, the male hinge member is also formed from a unitary, metal blank and includes a body portion with a pair of through openings for attaching the male hinge member to the second frame element, and three, spaced, parallel fingers extending therefrom. The two outer fingers are bent back at their terminal ends to provide spaced, coaxial loops, similar to loops 14 and 16 on female hinge member 10. A hinge pin passes through all four loops for pivotal attachment of the two hinge members, and thus hinged attachment of the two frame elements, to one another. As the male and female hinge members are moved about their pivotal attachment, cam 18 slidingly engages the surface of the middle finger of the male hinge member and deflects it in the manner of a cantilever spring. The pivot axis of the hinge members is so arranged relative to the positions of cam and spring contact that an overcenter spring action is provided, resiliently maintaining the two hinge members in one or the other of two, terminal, relative positions. Female hinge member 10 and the male hinge member used therewith correspond essentially to those disclosed in previously mentioned U.S. Pat. No. 3,145,748.

The female hinge member of the present invention, denoted generally by reference numeral 22, is shown individually in various views in FIGS. 2–5. Hinge member 22 is formed from an initially flat, unitary blank cut from a metal sheet of appropriate thickness and rigidity. Hinge member 22 has a longitudinal axis X—X, and what are termed proximal and distal ends 24 and 26, respectively. Body or leaf portion 28 has opposite, planar surfaces 30 and 32, and a pair of laterally spaced, through openings 36, 36'. A second pair of laterally spaced, through openings 38, 38' are cut while the blank is flat, near distal end 26. Ears 40 and 42 initially extending outwardly from central portion 44, are bent along lines parallel to axis X—X to extend at 90° to central portion 44 and parallel to one another, as shown. Although small portions of openings 38, 38' may extend into central portion 44, the openings are essentially coaxially aligned. Cylindrical roller 46 is rotatably mounted upon pin 48 which extends into or through openings of appropriate size in ears 40 and 42. As best seen in FIG. 5, edge portions of ears 40 and 42 adjacent the ends of roller 46 are rounded tangentially to the surface of the roller, which extends slightly outwardly of the ears.

Figure 7:
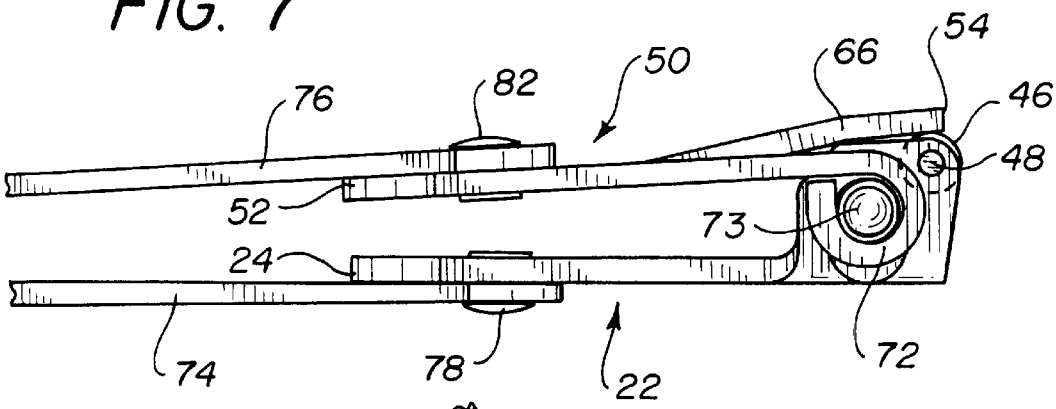
FIGS. 7 and 8 are side elevational views of the hinge assembly, with fragments of the framework, shown in what are termed closed and open positions, respectively.
Figure 8:
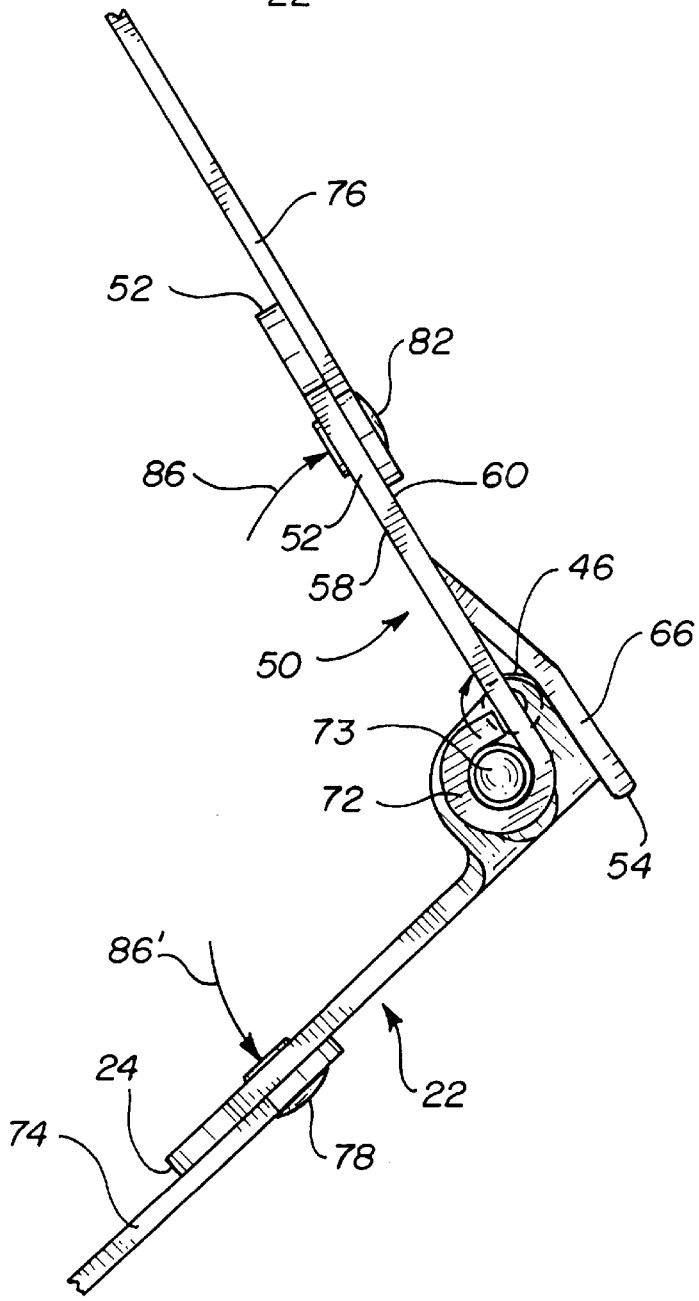

Turning now to FIGS. 6–8, female hinge member 22, is shown in its intended manner of use, cooperatively with prior art male hinge member 50. The latter is also formed as an initially flat, unitary blank cut from a sheet of metal having longitudinal axis Z—Z, and proximal and distal ends 52 and 54, respectively. Body portion 56 has opposite, planar surfaces 58, 60 and a pair of through openings 62, 62'. Three spaced, substantially parallel fingers 64, 66 and 68 are formed by cutting slots extending from distal end 54 to body portion 56. The terminal ends of outer fingers 64 and 68 are bent back to form loops 70 and 72, defining coaxially aligned openings.

The lateral distance or space between opposing, inner edges of loops 70 and 72 is slightly greater than the distance between the outer surfaces of ears 40 and 42. Female and male hinge members 22 and 50 are mutually assembled for relative pivotal movement about hinge pin 73 which extends through the openings defined by loops 70 and 72, as well as through openings 38, 38'. In order to align the axis of openings 38, 38' with that of loops 70 and 72, after placing ears 40 and 42 between the inner edges of loops 70 and 72, it is necessary to deflect middle finger 66 at the free, terminal end thereof which forms distal end 54. Finger 66 thus acts as a cantilever, leaf spring, applying a force to roller 46 after the openings have been aligned and pin 73 inserted therethrough.

Reference numerals 74 and 76 denote end portions of first and second frame members, respectively, of a conventional type of framework used in the construction of certain types of handbags. As shown, each of frame members 74 and 76 is formed of flat sheet metal. First frame member 74 is affixed at one end to female hinge member 22 by rivets 78 and 78' which extend through openings 80, 80' and 36, 36' in frame member 74 and hinge member 22, respectively. Second frame member 76 is affixed to male hinge member 50 by rivets 82, 82' which extend through openings 84, 84' and 62, 62' in frame member 76 and hinge member 50, respectively.

Hinge members 22 and 50 are shown in FIGS. 7 and 8 in their two, terminal positions of relative movement, defining terminal closed and open positions, respectively, of the mouth of the handbag of which the framework including frame members 74 and 76 forms a part. In FIG. 7 the hinge members are shown in what is termed the closed position, corresponding to the closed position of the handbag. The biasing force of finger/spring 66 upon roller/cam 46 tends to move proximal ends 24 and 52 of hinge members 22 and 50, respectively, toward one another. The proximal ends would, in fact, meet but for the fact that some degree of resistance, opposing the biasing force, is present in the framework itself.

When a manual force tending to move distal ends 24 a 52 apart is applied, normally by grasping opposite sides of the framework and pulling them apart, hinge members 22 and 50 are relatively rotated about the axis of hinge pin 73. During such movement, roller/cam 46 rolls along the surface of spring/finger 66 from distal end 54 toward proximal end 52. In the initial part of such movement, the biasing force applied to roller/cam 46 by spring/finger 66 tends to cause relative rotation of hinge members 22 and 50 back toward the closed position. In fact, the biasing force increases as spring/finger 66 is flexed to a greater degree and, if manual force is removed, the biasing force will move the hinge members back to the closed portion.

After roller/cam 46 is rolled along the inner surface of spring/finger 66 to the point where further movement decreases the amount of flexure, the direction hinge movement due to the biasing force changes, in the well-known manner of over-center springs. The biasing force then tends to move hinge members 22 and 50 to the fully open position, shown in FIG. 8, the biasing force being in the direction of arrows 86, 86'. Relative pivotal movement is limited by, i.e., the terminal open position of the hinge members is defined by, contact of spring/finger 66 near distal end 54 with distal end 26 of female hinge member 22 as also seen in FIG. 8.

Manual pressure moving opposite sides of the framework toward one another, of course, moves the hinge members (and the mouth of the handbag) back to the closed position. In both directions of movement, however, roller/cam 46 is in rolling rather than sliding contact with the opposing surface of spring/finger 66, thereby reducing friction and wear on the parts, consequently prolonging the life of the hinge and the handbag with which it is associated.

What is claimed is:

1. A hinge assembly for hingedly connecting first and second frame members of a handbag for movement of said frame members and the mouth of the handbag between terminal open and closed positions, said hinge assembly comprising:

a) a male hinge member formed from a first, unitary, metal blank and having a first longitudinal axis, first proximal and distal ends, a flat, first body portion centrally intersected by said first axis, a cantilever spring extending from said first body portion along said first axis and having a free end coterminal with said first distal end, and two, elongated fingers extending from said first body portion, one on each side of and substantially parallel to said cantilever spring and spaced therefrom by cut-out areas, each of said fingers having terminal ends bent to form substantially closed, coaxial loops laterally adjacent said free end of said spring;

b) a female hinge member formed from a second, unitary, metal blank and having a second longitudinal axis, second proximal and distal ends, a flat, second body portion centrally intersected by said second axis, a central portion extending from said second body portion, centrally intersected by said second axis and having a free end coterminal with said second distal end, a pair of ears, one on each side of said central portion and joined thereto along lines parallel to and equally spaced from said second axis, each of said ears having at least one through opening;

c) a cylindrical roller having an axial length at least as great as the width of said spring over a predetermined portion of the length thereof mounted between and supported by each of said ears for rotation about a third axis, perpendicular to said second axis; and d) a hinge pin extending through said coaxial loops of said male hinge member and openings in said ears of said female hinge member for interconnecting said male and female hinge members for relative rotation about a fourth axis, through said hinge pin, parallel to and spaced from said third axis, said fourth axis being spaced farther from said second distal end than said third axis, between terminal closed and open positions with said roller in flexing contact with and rolling along said predetermined portion of said spring during said relative rotation.

2. The invention according to claim 1 wherein said pair of ears have opposed, parallel, planar surfaces on opposite sides of said second axis spaced by a distance slightly greater than the axial length of said roller.

3. The invention according to claim 2 wherein each of said ears includes a rounded edge portion spaced closely, axially outwardly a respective end of said roller and rounded concentrically about said third axis in a cylindrical plane spaced closely, radially inwardly of the plane of the surface of said roller.

4. The invention according to claim 3 wherein said central portion of said female hinge member includes an edge portion extending between said ears, parallel to said third axis and defining said second distal end.

5. The invention according to claim 4 wherein said terminal open position is defined by contact of said spring with said second distal end.

6. The invention according to claim 5 wherein said spring contacts said second distal end at a position closely adjacent said first distal end when said hinge members are in said terminal closed position.

7. A female hinge member for pivotal connection to a male hinge member having a cantilever spring of predetermined width over at least a portion of its length and which is flexed during relative pivotal movement of said hinge members between open and closed positions corresponding to respective open and closed positions of a handbag having a framework to which said hinge members are fixedly attached, said female hinge member comprising:

a) a body portion having opposite, parallel, planar surfaces, a first, central, longitudinal axis, a proximal end and a pair of first side edges parallel to and spaced equally from and on opposite sides of said first axis;

b) a central portion extending integrally from said body portion and having a pair of second edges parallel to and spaced equally on opposite sides of said first axis, and a distal end;

c) a pair of ears, one on each side of said central portion and integrally joined thereto along said second side edges, said ears having opposed, parallel, planar surfaces spaced by a predetermined distance;

d) each of said ears having a first opening and a second opening, said first opening of said ears being aligned along a second axis, perpendicular to said first axis, and said second opening of said ears being aligned along a third axis, parallel to and closer to said distal end than said second axis; and e) a cylindrical roller mounted upon and supported by each of said ears for rotation about said third axis, said roller having an axial length slightly less than said predetermined distance.

8. The invention according to claim 7 wherein said support means comprises a pair of ears positioned on opposite sides of said first axis.

9. The invention according to claim 7 wherein each said ears include respective edge portions adjacent opposite ends of said roller, said edge of portions being rounded concentrically with and spaced slightly within the plane of the surface of said roller.

10. The invention according to claim 7 and further including a pivot pin extending axially from opposite ends of said roller and into second openings in said ears.

11. The invention according to claim 7 and further including a plurality of through openings in said body portion for passage of fastening means for fixedly attaching said female hinge member to said framework.

12. The invention according to claim 11 wherein at least one of said through openings is positioned on each side of said first axis.

13. The invention according to claim 7 wherein said second side edges are spaced from one another by a distance less than the spacing of said first side edges, whereby said central portion is narrower than said body portion.

* * * * *